US007824219B2

(12) United States Patent
Wang

(10) Patent No.: US 7,824,219 B2
(45) Date of Patent: Nov. 2, 2010

(54) ELECTRICAL CONNECTOR HAVING A CONNECTING SHEET FOR RESISTING ELECTRONIC INTERFERENCE

(75) Inventor: Zhen-Sheng Wang, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/387,279

(22) Filed: Apr. 30, 2009

(65) Prior Publication Data

US 2010/0022132 A1 Jan. 28, 2010

(30) Foreign Application Priority Data

Jul. 24, 2008 (CN) ..... 2008 2 0039108 U

(51) Int. Cl.
*H01R 31/00* (2006.01)

(52) U.S. Cl. ..... 439/607.27

(58) Field of Classification Search ..... 439/541.5, 439/607.01, 670.02, 607.05, 607.06, 607.09, 439/607.17
See application file for complete search history.

(56) References Cited

U.S. PATENT DOCUMENTS 6,206,730 B1 * 3/2001 Avery et al. ..... 439/607.18
6,287,146 B1 * 9/2001 Avery et al. ..... 439/607.4
6,447,311 B1 * 9/2002 Hu et al. ..... 439/108
7,044,790 B2 * 5/2006 Zhu et al. ..... 439/607.27
7,654,866 B2 * 2/2010 He et al. ..... 439/607.01

* cited by examiner

*Primary Examiner*—Neil Abrams
*Assistant Examiner*—Phuong Nguyen
(74) *Attorney, Agent, or Firm*—Andrew C. Cheng; Wei Te Chung; Ming Chieh Chang

(57) ABSTRACT

An electrical connector includes an insulative housing (100), a plurality of contacts (3) retained in the housing, a shell covering on the housing (100) and a metal connecting sheet (7). The insulative housing defines an insulative base (1) and a mating portion (2) extending forwards out of a front face (10) of the insulative base, and the contacts are retained in the mating portion. The shell defines a first shell (4) covering outside of the mating portion, and a second shell (5) covering outside of the insulative housing. The metal connecting sheet defines at least one first contacting arm (74) connecting with the first shell, at least one second contacting arm (73) connecting with the second shell and a main portion (72) connecting with the at least one first and second contacting arms, and the front face of the insulative base is wholly covered by the main portion.

13 Claims, 6 Drawing Sheets

ELECTRICAL CONNECTOR HAVING A CONNECTING SHEET FOR RESISTING ELECTRONIC INTERFERENCE

BACKGROUND OF THE INVENTION

1. Field of the Invention

The present invention relates to an electrical connector, and especially to an electrical connector having a connecting sheet for resisting electronic interference.

2. Description of the Related Art

U.S. Pat. No. 7,044,790 discloses an electrical connector including an insulative housing defining a base portion and a mating portion extending forwards from a front face of the base portion, a first shell, a second shell and a metal connecting piece. The first shell covers outside of the base portion and the second shell covers outside of the mating portion. The connecting piece defines a main portion attaching to partly of the front face of the base portion and two contacting portion extending from two opposite sides of the main portion. The connecting piece links the first and second shells by the contacting portions respectively connecting with the two shells. But, the main portion attaches to and covers only part of the front face of the base portion, which may provide a poor function of resisting electronic interference.

Hence, an electrical connector having a good function of resisting electronic interference is designed.

SUMMARY OF THE INVENTION

Accordingly, an object of the present invention is to provide an electrical connector having a good function of resisting electronic interference.

In order to achieve the object set forth, an electrical connector includes an insulative housing, a plurality of contacts retained in the housing, a shell covering on the housing and a metal connecting sheet. The insulative housing defines an insulative base and a mating portion extending forwards out of a front face of the insulative base, and the contacts are retained in the mating portion. The shell defines a first shell covering outside of the mating portion, and a second shell covering outside of the insulative housing. The metal connecting sheet defines at least one first contacting arm connecting with the first shell, at least one second contacting arm connecting with the second shell and a main portion connecting with the at least one first and second contacting arms, and the front face of the insulative base is wholly covered by the main portion.

Other objects, advantages and novel features of the invention will become more apparent from the following detailed description of the present embodiment when taken in conjunction with the accompanying drawings.

DETAILED DESCRIPTION OF THE INVENTION

Figure 1:
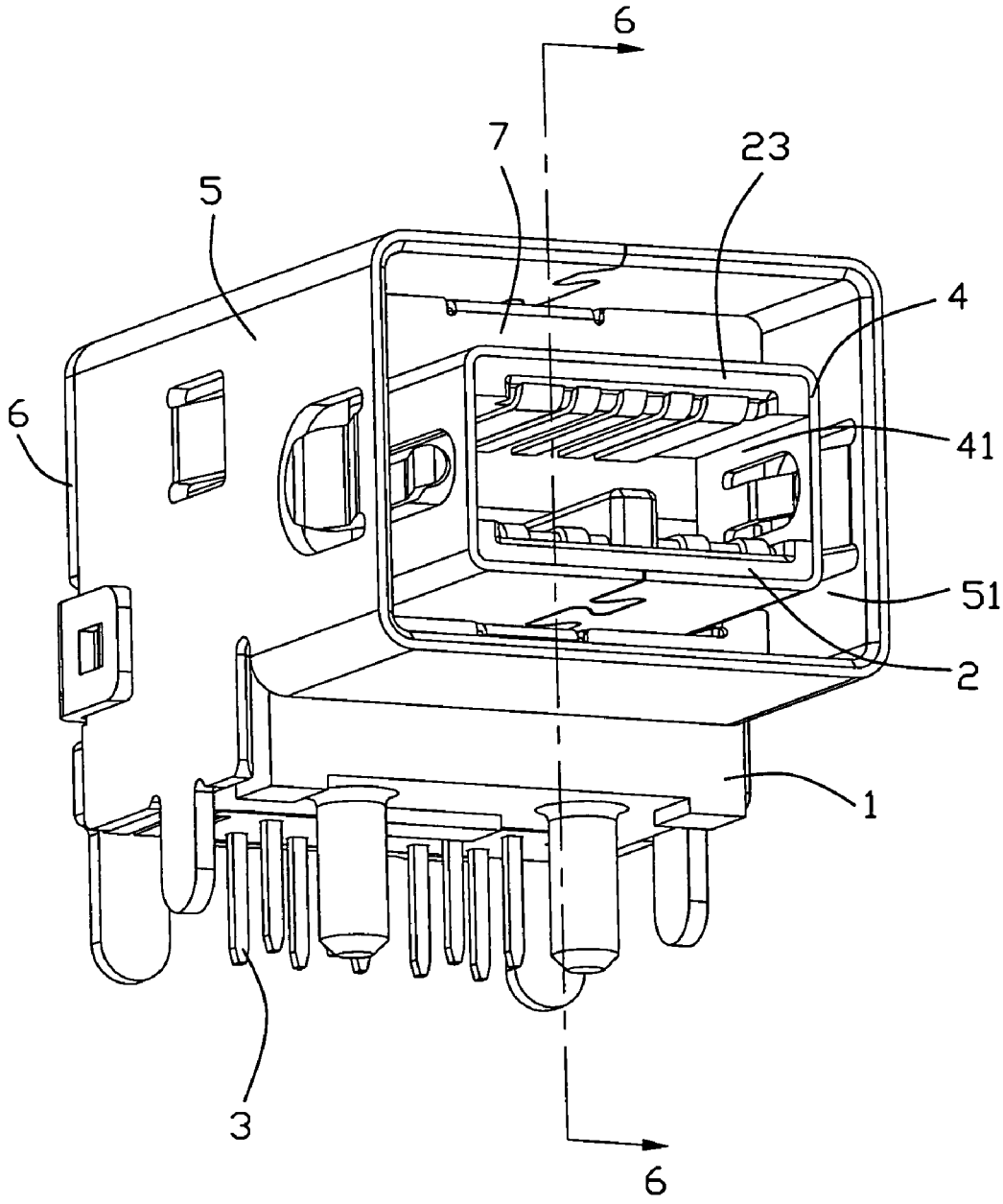
FIG. 1 is a front perspective view of an electrical connector in accordance with the present invention.

Reference will now be made to the drawing figures to describe a preferred embodiment of the present invention in detail.

Figure 6:
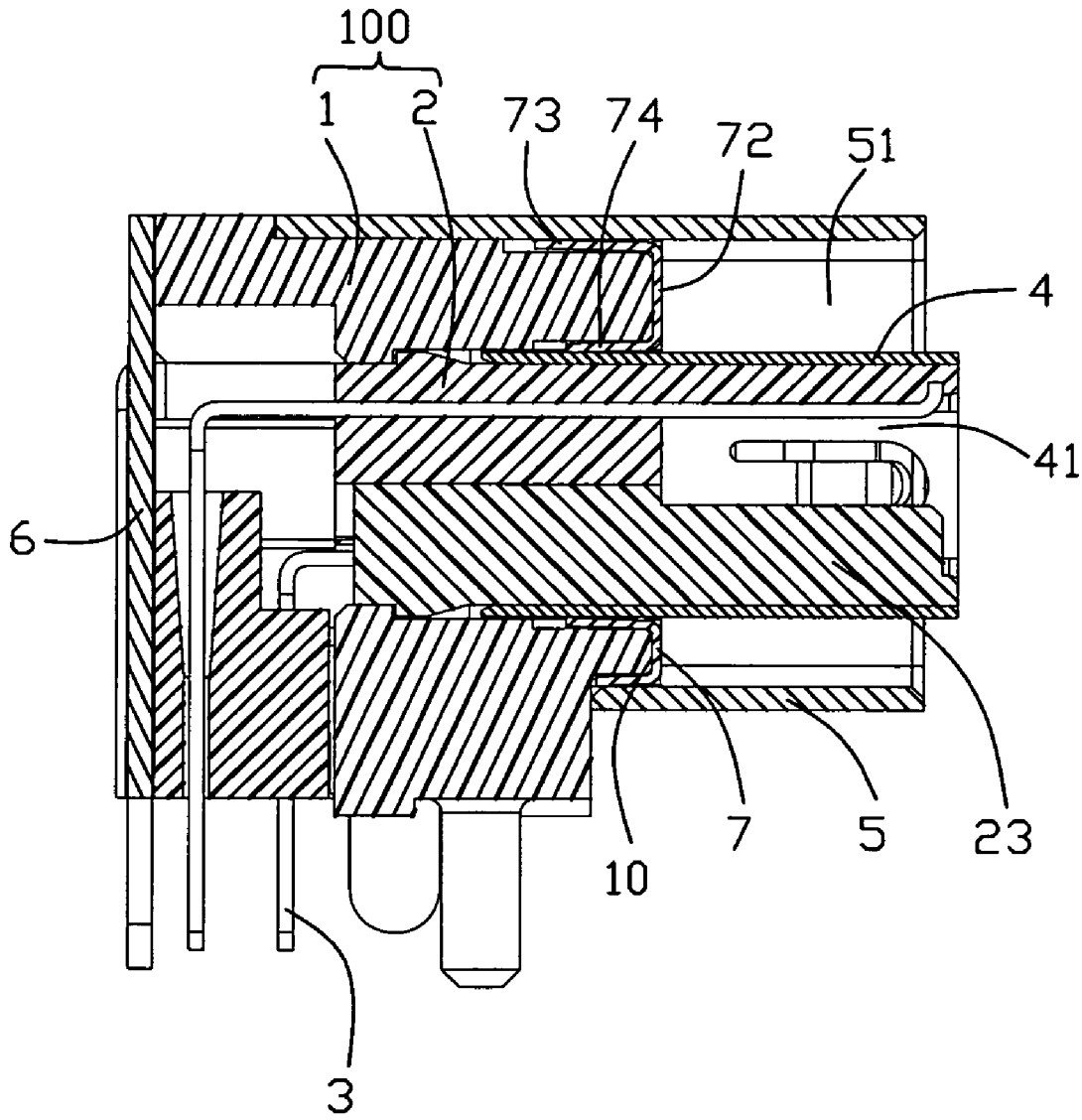
FIG. 6 is a cross-sectional view of FIG. 1 taken along line 6-6.

Referring to FIG. 1 and FIG. 6, an electrical connector includes an insulative housing 100, a plurality of contacts 3 retained in the housing, a shell covering on the housing 100 and a metal connecting sheet 7.

Figure 2:
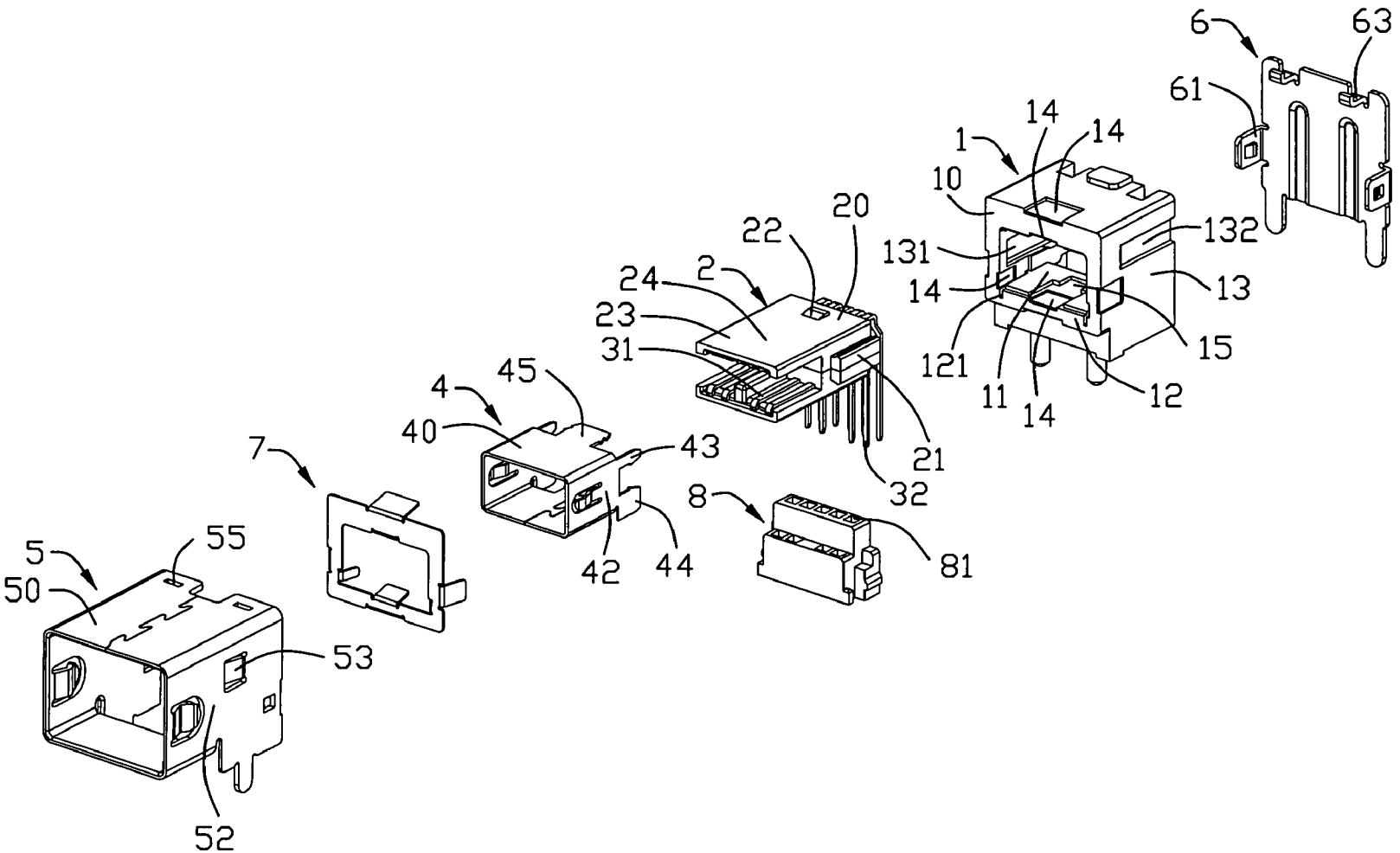
FIG. 2 is a front exploded view of the electrical connector shown in FIG. 1.
Figure 3:
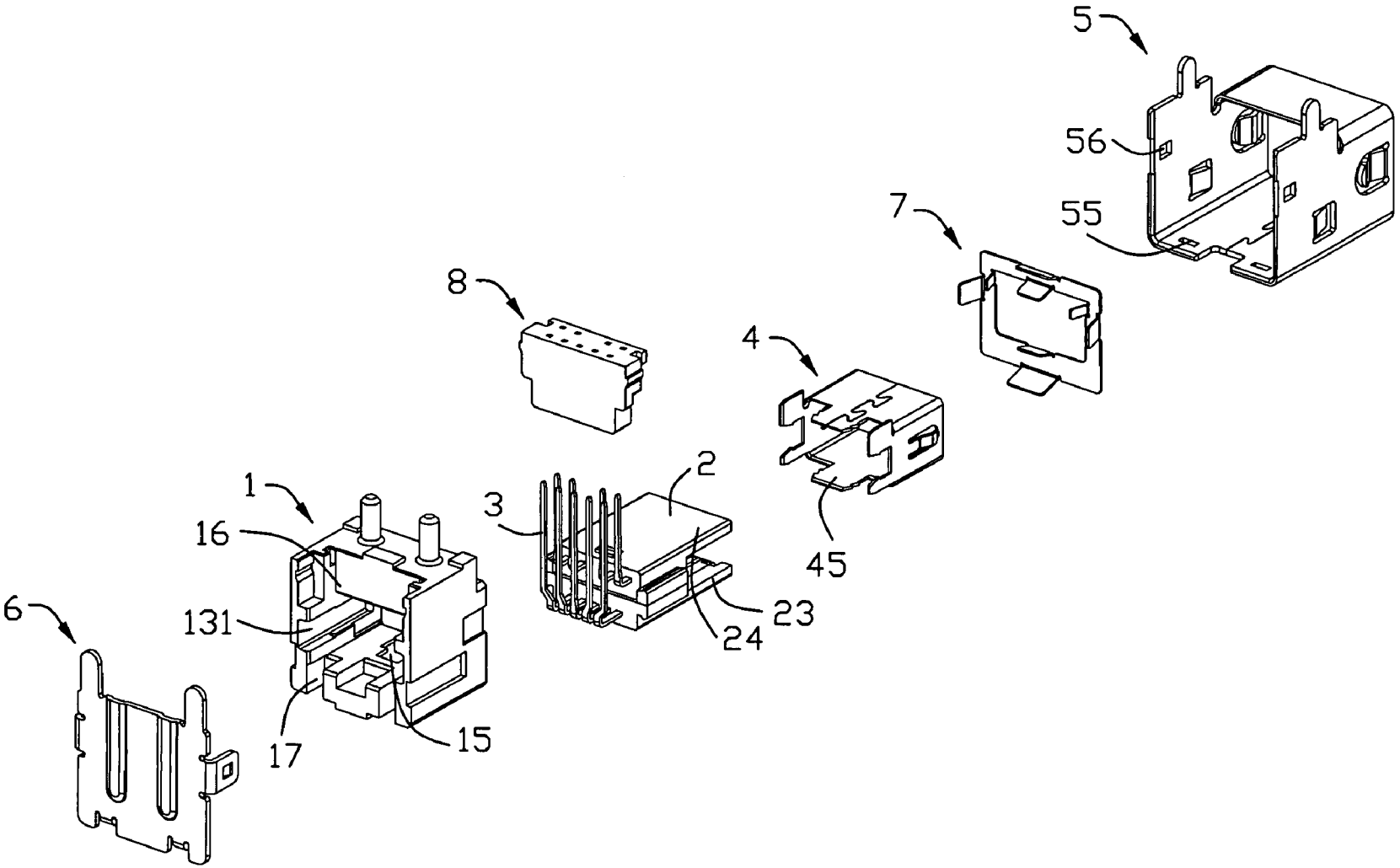
FIG. 3 is a rear exploded view of the electrical connector shown in FIG. 1.

Referring to FIG. 2 and FIG. 3, the insulative housing 100 includes a rectangular insulative base 1 and a contact module 2 assembled to the insulative base 1. The insulative base 1 has a front face 10 defined as a mating face and a rear face opposite to the front face 10. A rectangular receiving room 11 disposed at a middle portion of the insulative base 1 runs through the opposite front/mating face 10 and rear face. The insulative base 1 defines a top wall, a bottom wall 12 opposite to the top wall and a pair of sidewalls 13 connecting to the top wall and the bottom wall 12, and the receiving room 11 is surrounded by the four side walls. Each of the walls defines a receiving groove 14 extending rearwards from the front/mating face 10 at both inner and outer face thereof, and the pair of sidewalls 13 each defines a retaining slot 131 extending rearwards at the inner face thereof, and the retaining slot 131 runs through the rear face of the insulative base 1 and is positioned above the corresponding receiving groove 14 adjacent to the bottom wall 12. The inner faces of the top and bottom walls each defines a restricting slot 15 above and communicating with the receiving groove 14.

Referring to FIG. 2 and FIG. 3, the contact module 2 insert-molded with a plurality of contacts 3 defines a base portion 20 and a pair of parallel tongue portions 23 extending forwards from the base portion 20. The base portion 20 defines a retaining portion 21 projecting outwards from each of the two opposite outer walls thereof. The pair of tongue portions 23 stack in a vertical direction and separate from each other. The contacts 3 are respectively arranged in two opposite inner surfaces of the two tongue portions 23, and each contact 3 defines contacting portion 31 exposed to the inner surface of the tongue portions 23 and a soldering leg 32 extending downwards and into a room 16 opening rearwards and downwards at a rear portion of the insulative base 1. The contact module 2 is assembled to the insulative base 1 from the rear face with the retaining portions 21 each aligning with the corresponding retaining slot 131, and the base portion 20 finally is retained in the receiving room 11 by the retaining portions 21 engaging with the retaining slots 131. The protrusions 22 projecting from the top and the bottom faces of the base portion 20 respectively enter into the restricting slot 15 and are restricted therein to prevent the base portion 20 from further moving rearwards. The tongue portions 23 extend out of the receiving room 11 and beyond the front face 10. The tongue portions 23 retaining the contacts 3 therein and extending forwards from the front face of the insulative base 1 are defined as a mating portion 24. A spacer 8 is assembled upwards and retained in the room 16, and the soldering legs 32 run through the through holes 81 and extend towards the PCB.

Referring to FIG. 2 and FIG. 3, the shell defines a first/inner shell 4, a second/outer shell 5 and a cover 6. The first shell 4 defines a board shaped top piece 40, a flat bottom piece opposite to the top piece 40 and a pair of side pieces 42 connecting with the top and bottom pieces. Each side piece 42 defines two opposite extending arms 43, 44 extending rearwards from the rear edge thereof. The first shell 4 is assembled to the contact module 2 in a front-to-rear direction, and the first shell 4 is retained to the contact module 2 by the extending arms 43, 44 clipping the corresponding retaining portion 21. A lower edge of the extending arm 44 is retained in a slot 121 disposed at the joint of the bottom wall 12 and the sidewall 13. The top and bottom pieces each defines a retaining piece 45 extending rearwards from a rear edge thereof, and the first shell 4 is retained to the insulative base 1 steadily by the retaining pieces 45 engaging with the restricting slots 15. The first shell 4 covers outside of the mating portion 24 and provides a first receiving cavity 41 therein (shown in FIG. 1). The second shell 5 defines a second top piece 50, a second bottom piece opposite to the second top piece 50 and a pair of second side pieces 52 connecting with the top and bottom pieces. The rear cover 6 defines a board shaped main body and a pair of latching arms 61 extending forwards from two side edges thereof.

Figure 4:
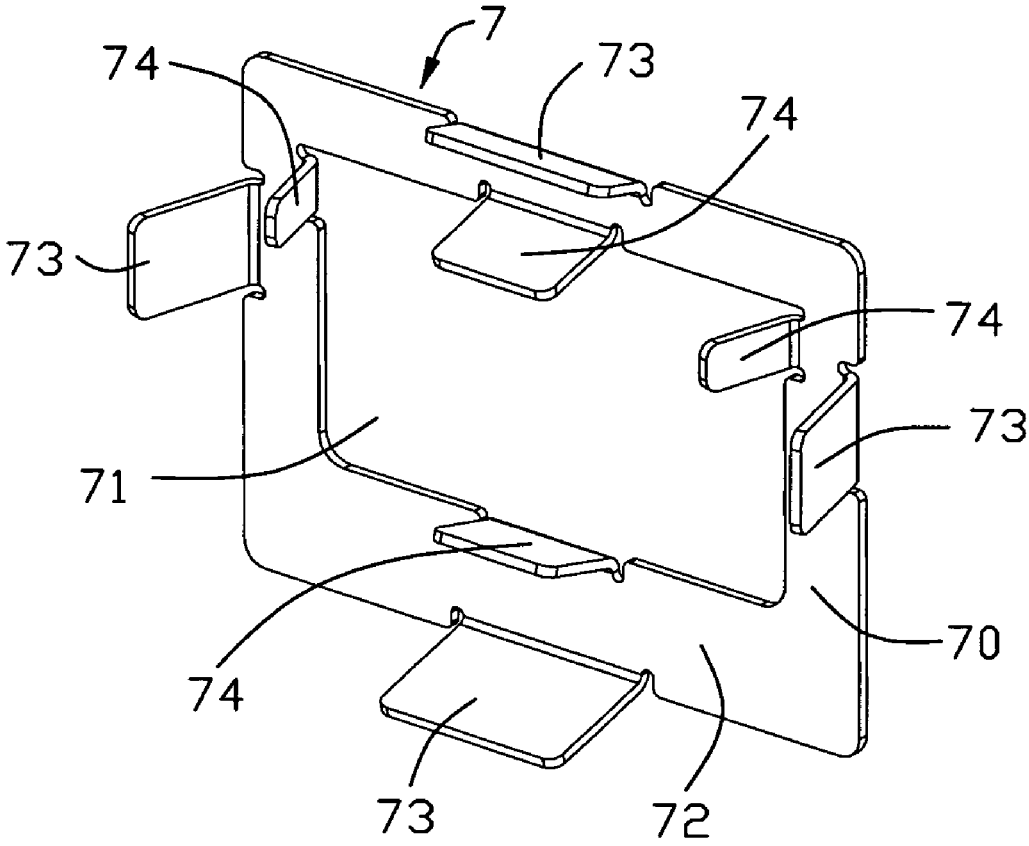
FIG. 4 is a perspective view of the connecting sheet shown in FIG. 2.
Figure 5:
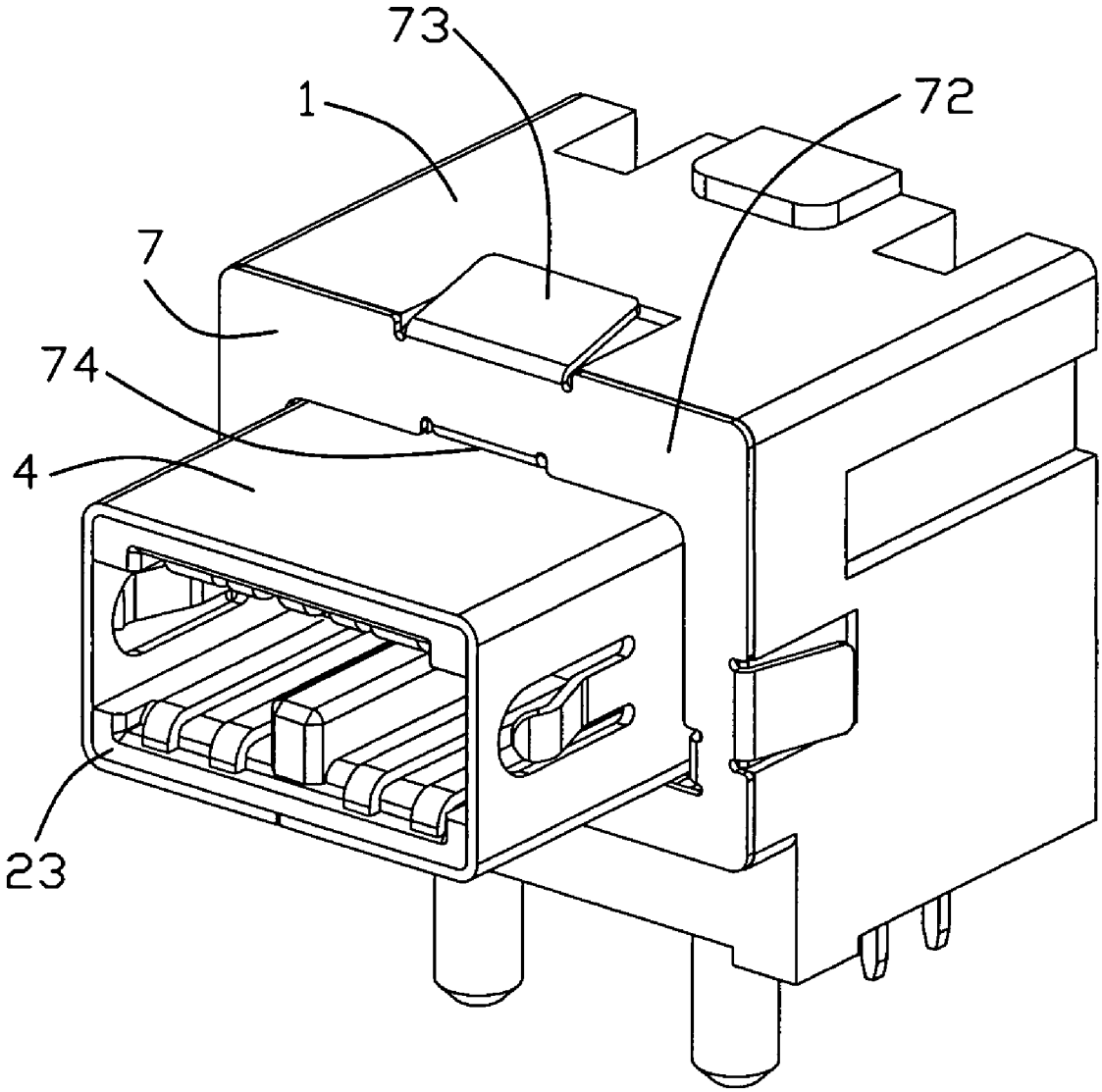
FIG. 5 is a partly perspective view of the electrical connector without the second shell and the rear cover.

Referring to FIG. 4 and FIG. 5, the metal connecting sheet 7 defines a flat main portion 72 with a through hole 71 at a middle portion thereof, and the main portion 72 is provided as a frame with four sides 70 connecting to each other. Each of the sides 70 defines a first elastic contacting arm 74 extending slantways and rearwards from an inner edge positioned in the through hole 71 and a second contacting arm 73 extending slantways and rearwards from an outer edge opposite to the inner edge. The first and second contacting arms 74, 73 extend rearwards and away from each other. The metal connecting sheet 7 is assembled to the insulative base 1 in a front-to-rear direction, and the first contacting arms 74 enter into the corresponding receiving grooves 14 and then are elastically impacted by the first shell 4. The second contacting arms 73 extend rearwards and outwards from an outer surface of the walls of the insulative base 1. The front face 10 of the insulative base 1 is wholly covered by the main portion 72 and the mating portion 24 projects out of the through hole 71. The second shell 5 covers outside of the insulative base 1 in a front-to-rear direction, and a second receiving cavity 51 is provided between the first shell 4 and the second shell 5. The second contacting arms 73 are elastically impacted into the receiving slot 14 by the second shell 5, and the metal connecting sheet 7 links the first shell 4 to the second shell 5. The cover 6 retains the second shell 5 to the insulative base 1 by the latching arms 61 locking with the engaging holes 56 disposed in the second side pieces 52 and the retaining pieces 63 extending into and locking with the retaining holes 55 of the top piece 50. The elastic piece 53 projecting from each second side piece 52 enters into a slot 132 of the insulative base 1 and engages with the slot 132 to prevent the second shell 5 from further moving forwards.

The metal connecting sheet 7 links the first shell 4 to the second shell 5 by the first contacting arms 74 contacting to the outer surface of the first shell 4, and the second contacting arms 73 contacting to the inner surface of the second shell 5, which can resist electronmagnetic interference of the electrical connector. Moreover, the front face 10 of the insulative base 1 is wholly covered by the main portion 72, which can enhance the function of resisting electronmagnetic interference by increasing the covered area of the insulative base 1.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing defining an insulative base and a mating portion extending forwards out of a front face of the insulative base;

a plurality of contacts received and retained in the mating portion;

a first shell covering outside of the mating portion;

a second shell covering outside of the insulative housing; and a metal connecting sheet defining at least one first contacting arm connecting with the first shell, at least one second contacting arm connecting with the second shell and a main portion connecting with the at least one first and second contacting arms, and the front face of the insulative base wholly covered by the main portion;

the metal connecting sheet is a frame shaped and defines four sides connecting to each other, and the at least one first contacting arm and the at least one second contacting arm are disposed on each of sides of the insulating base;

the insulative base defines a receiving room running through the front face thereof and communicating with a through hole defined in the connecting sheet, and the mating portion is retained in the receiving room and partly projecting out of the receiving room.

2. The electrical connector as described in claim 1, wherein the metal connecting sheet defines a through hole for permitting the mating portion passing through.

3. The electrical connector as described in claim 2, wherein the at least one first contacting arm extends rearwards from an inner edge disposed in the through hole, and the at least one second contacting arm extends rearwards from an outer edge opposite to the inner edge.

4. The electrical connector as described in claim 3, wherein said first contacting arm and said second contacting arm are aligned with each other either vertically or horizontally.

5. The electrical connector as described in claim 2, wherein said metal connecting sheet includes the second contacting arm sandwiched between the housing and the second shell, and the first contacting arm sandwiched between the housing and the first shell.

6. The electrical connector as described in claim 5, wherein the insulative base defines at least one receiving groove at an inner face of the receiving room for receiving the at least one first contacting arm and at least one receiving groove at an outer face of the receiving room for receiving the at least one second contacting arm.

7. The electrical connector as described in claim 6, wherein the at least one first contacting arm is pressed into the corresponding receiving groove by the first shell, and the at least one second contacting arm is pressed into the corresponding receiving groove by the second shell.

8. The electrical connector as described in claim 7, wherein the receiving room defines two opposite sidewalls each defining a retaining slot extending rearwards at an inner face thereof, and the mating portion comprises two opposite retaining portions engaged with retaining slots.

9. The electrical connector as described in claim 8, wherein the first shell defines a pair of opposite side pieces each defining two opposite extending arms extending rearwards from a rear edge thereof for clipping corresponding retaining portions.

10. An electrical connector comprising:

a contact module defining a mating port behind a front mating face thereof;

a plurality of contacts disposed in the contact module with contacting sections extending into the mating port;

an inner shell enclosing the contact module;

an insulative housing enclosing a rear portion of the assembled inner shell and contact module;

an outer shell enclosing the housing and surrounding a front portion of the assembled inner shell and contact module under condition that a tubular gap is formed between the inner shell and the outer shell and the front mating face is hidden behind a front edge of the outer shell; and a metal connecting sheet defining at least one inner leg connecting with the inner shell, at least one outer leg connecting with the outer shell and a main portion connecting with the at least one inner and outer legs, and a front face of the housing wholly covered by the main portion;

the metal connecting sheet is a frame shaped and defines four sides connecting to each other, and the at least one inner leg and the at least one outer leg are disposed on each of two sides;

the insulative base defines a receiving room running through the front face thereof and communicating with a through hole defined in a connecting sheet, and the mating port is retained in the receiving room and partly projecting out of the receiving room.

11. The electrical connector as claimed in claim 10, wherein said connecting sheet includes the outer leg sandwiched between the housing and the outer shell, and the inner leg sandwiched between the housing and the inner shell.

12. The electrical connector as claimed in claim 11, wherein said housing defines an inner recess in an inner surface and an outer recess in an outer surface to receive the corresponding inner leg and outer leg, respectively.

13. The electrical connector as claimed in claim 11, wherein said inner leg and said outer leg are aligned with each other either vertically or horizontally.

* * * * *